US007487568B2

(12) United States Patent
Cirette et al.

(10) Patent No.: US 7,487,568 B2
(45) Date of Patent: Feb. 10, 2009

(54) MULTIPLE STATION MACHINE FOR CLEANING A CONTAINER BY SCOURING WITH A COMPRESSED GAS PERIPHERAL JET

(75) Inventors: Damien Cirette, Octeville sur Mer (FR); Philippe Freire Diaz, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 148 days.

(21) Appl. No.: 11/632,658

(22) PCT Filed: Jul. 8, 2005

(86) PCT No.: PCT/EP2005/053277

§ 371 (c)(1),
(2), (4) Date: Mar. 19, 2007

(87) PCT Pub. No.: WO2006/010701

PCT Pub. Date: Feb. 2, 2006

(65) Prior Publication Data

US 2007/0272287 A1 Nov. 29, 2007

(30) Foreign Application Priority Data

Jul. 20, 2004 (FR) ..... 04 51590

(51) Int. Cl.
*A47L 5/14* (2006.01)

(52) U.S. Cl. ..... 15/304; 15/309.2; 15/319

(58) Field of Classification Search ..... 15/304, 15/309.2, 345, 319; *A47L 5/14, 15/00*
See application file for complete search history.

(56) References Cited

U.S. PATENT DOCUMENTS

| | | | | |
|---|---|---|---|---|
| 1,940,615 A | | 12/1933 | Webster | |
| 4,461,054 A | * | 7/1984 | Oehlenschlager et al. | 15/304 |
| 5,487,200 A | * | 1/1996 | Herzog | 15/1.51 |
| 5,546,631 A | * | 8/1996 | Chambon | 15/319 |
| 5,713,101 A | * | 2/1998 | Jackson | 15/302 |

FOREIGN PATENT DOCUMENTS

| | | |
|---|---|---|
| EP | 0 381 841 | 8/1990 |
| EP | 0 636 427 | 2/1995 |

* cited by examiner

*Primary Examiner*—David A Redding
(74) *Attorney, Agent, or Firm*—Young & Thompson

(57) ABSTRACT

A machine for cleaning the inner walls (66, 75) of a receptacle (12), includes several cleaning stations of which one is fitted with an insufflation tube (36) that is connected to a source of pressurized gas and that is provided with a nozzle (38) insufflating the gas towards the inner walls (66, 75) of the receptacle (12) during a cleaning cycle including an ascending phase and a descending phase (Pd) of the insufflation tube (36), the nozzle (38) having an annular peripheral slot (64) that is capable of forming a peripheral jet (f2) of gas of generally frustoconical shape directed towards the inner side walls (66) of the receptacle (12) and towards the bottom, and the peripheral jet (f2) being triggered for at least a part of the descending phase (Pd).

10 Claims, 5 Drawing Sheets

MULTIPLE STATION MACHINE FOR CLEANING A CONTAINER BY SCOURING WITH A COMPRESSED GAS PERIPHERAL JET

TECHNICAL FIELD OF THE INVENTION

The present invention relates to a multiple station machine for cleaning a container by scouring and a method of controlling the machine.

The present invention relates more particularly to a machine for cleaning the inner walls of a container such as a bottle of the type comprising several cleaning stations that are mounted so as to rotate about a main axis and that are distributed circumferentially about the main axis.

PRIOR ART

This type of machine may be arranged in an installation for the treatment of bottles made of plastic such as polyethylene terephthalate (PET) for the purpose of depositing an inner coating forming a barrier by means of a microwave plasma.

During the bottle treatment step, a precursor fluid is injected into the bottle and subjected to the microwave action so that it changes to the plasma state and causes a deposit on the inner walls of the bottle. It is for example a known practice to produce deposits based on hydrogenated amorphous carbon that forms an inner coating forming a barrier, particularly against molecules of dioxygen and of carbon dioxide, by using acetylene as a precursor; it is also a known practice to produce silica-based deposits, by using an organo-silica composite as a precursor.

After the treatment step; it is necessary to clean the inside of the bottle so as to remove therefrom the reaction residues that have been deposited on its inner walls but that do not form part of the inner coating.

More generally, this type of machine may be arranged in any installation for processing receptacles, whether they are made of plastic or not, which receptacles require being rid of residues that they are likely to contain inside: thus, without it being limiting, it may concern installations for cleaning reused receptacles or receptacles that have been stored between their being manufactured and their being stored.

The current machines clean the inner walls of the bottle by insufflating air, via the nozzle, in a jet directed axially towards the bottom wall of the bottle.

In addition, the opening of the bottle is connected to a suction device that recovers the residues detached by means of the insufflation of air.

SUMMARY OF THE INVENTION

The present invention aims to enhance this machine by improving its cleaning efficiency, so as to eliminate the residues completely and at a high rate.

For this purpose, the invention proposes a cleaning machine characterized in that each cleaning station is fitted with an insufflation tube that extends along a substantially vertical axis, that is connected to a source of pressurized gas, and that is provided, at its top axial end, with a generally cylindrical nozzle designed to insufflate the gas towards the inner walls of the receptacle, and each station is of the type comprising support means that hold the receptacle generally vertically so that the opening of the receptacle is arranged downwards on the axis of the insufflation tube, of the type in which the insufflation tube is controlled so as to slide along its axis, during a cleaning cycle, between a top axial position, in which the nozzle extends inside the receptacle, and a bottom axial position, the cleaning cycle comprising an ascending phase corresponding to the ascending travel of the insufflation tube, from its bottom position to its top position, and a descending phase corresponding to the descending travel of the insufflation tube, from its top position to its bottom position, and characterized in that the nozzle comprises an annular peripheral slot that is capable of forming a peripheral jet of pressurized gas of generally frustoconical shape directed towards the inner side walls of the receptacle and downwards, when the nozzle extends inside the receptacle, and in that the peripheral jet is triggered for at least a part of the descending phase inside the receptacle.

According to other features of the invention:

- the insufflation tube comprises a peripheral annular duct that opens on the outside of the annular slot and a central duct that opens on the outside of a central orifice situated at the free axial end of the nozzle, and the central orifice is capable of producing a central jet of pressurized gas directed towards the bottom inner facing wall of the receptacle, when the nozzle extends inside the receptacle;
- the machine comprises means for distributing gas that supply only the central duct during at least a part of the ascending phase and that supply only the peripheral duct during at least a part of the descending phase;
- the source of pressurized gas is common to several cleaning stations, and the machine is fitted with a gas distributor comprising:
  - a main fixed duct that is coaxial with the main axis, that is connected to the source of pressurized gas and that comprises, in its axial wall, at least one distribution window,
  - a connection hub that is mounted so as to rotate about a main duct, that is connected rotatably to the cleaning stations and that comprises a series of radial channels,
- and each radial channel comprises, at its outer end, an outer orifice that is connected to the insufflation tube of an associated cleaning station and, at its inner end, an inner orifice that opens in line with the distribution window during an angular sector of the rotation cycle of the hub so as to cause the supply of the associated insufflation tube during an adequate period of the cleaning cycle;
- the connection hub comprises a top series of radial channels that are connected to the respective central ducts of the associated insufflation tubes and a bottom series of radial channels that are connected to the respective peripheral ducts of the associated insufflation tubes, and the main duct comprises a top distribution window that is associated with the top series and a bottom distribution window that is associated with the bottom series;
- considering a determined insufflation tube, during the ascending phase, the inner orifice of the radial channel associated with the central duct comes into line with the bottom distribution window, the inner orifice of the radial channel associated with the peripheral duct being in line with the axial wall of the main duct, and, during the descending phase, the inner orifice of the radial channel associated with the peripheral duct comes into line with the top distribution window, the inner orifice of the radial channel associated with the central duct being in line with the axial wall of the main duct, so that only the central duct is supplied with gas during the majority of the ascending phase, and so that only the peripheral duct is supplied with gas during the majority of the descending phase;

considering a determined insufflation tube, in the vicinity of the top position of the insufflation tube, the inner orifices of the two associated radial channels come into line with the corresponding distribution windows so that the central duct and the peripheral duct are supplied with gas simultaneously for a determined lapse of time;

each window extends over an angular sector of a value greater than the angular gap between two consecutive inner orifices so as to supply simultaneously at least two radial channels of the same series;

the gas consists of compressed air.

BRIEF DESCRIPTION OF THE FIGURES

Other features and advantages of the invention will appear on reading the following detailed description for the understanding of which reference will be made to the appended drawings in which.

DETAILED DESCRIPTION OF THE FIGURES

In the following description, identical, similar or analogous elements will be indicated by the same reference numbers.

Figure 1:
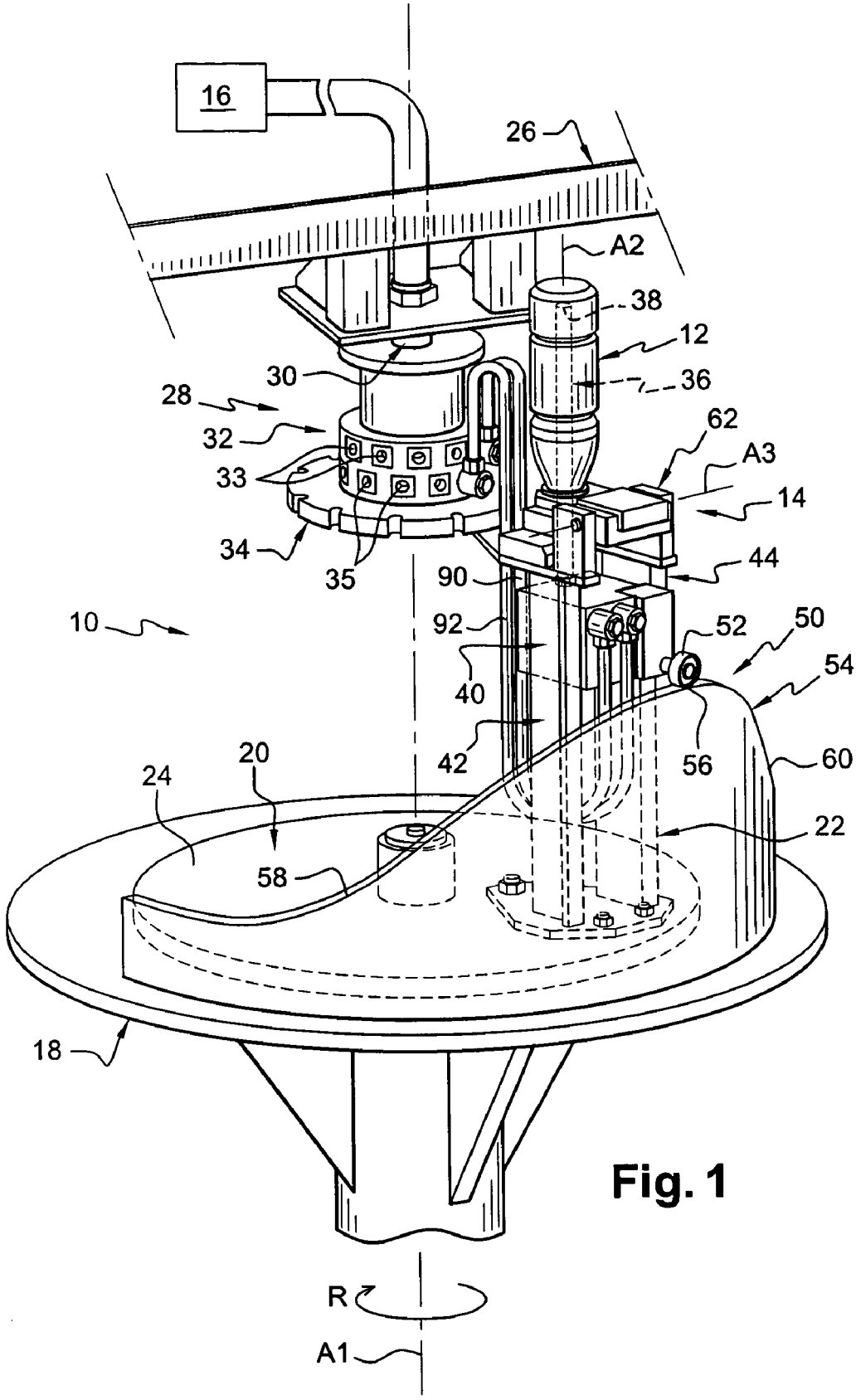
FIG. 1 is a view in perspective that represents schematically a cleaning machine fitted with a cleaning station according to the teachings of the invention.

FIG. 1 shows a machine 10 for cleaning by insufflation the inner walls of a receptacle such as a bottle 12 made according to the teachings of the invention.

The machine 10 is designed in particular to be arranged in an installation for treating bottles 12, for the purpose of extracting therefrom the residues that pollute the inside of the bottles 12. Preferably, when the installation for treating bottles 12 is designed to produce a barrier coating (carbon- or silica-based for example), the machine 10 is placed immediately downstream of the treatment unit making it possible to produce the said barrier coating in order that the reaction residues are eliminated as quickly as possible. The machine may also be arranged upstream of a filling installation.

The machine 10 comprises several cleaning stations 14 that are mounted so as to rotate about a main vertical axis A1 and that are distributed circumferentially about the main axis A1.

According to a variant embodiment (not shown), the main axis A1 could be inclined relative to the vertical direction.

To simplify the representation, a single cleaning station 14 is shown in FIG. 1.

Each cleaning station 14 is designed to be connected to a source 16 of pressurized gas, such as compressed air. The source 16 of compressed air is common to all the cleaning stations 14.

The machine 10 comprises a fixed base 18 onto which a platform 20 is mounted so as to rotate about the main axis A1.

The platform 20 is rotated about its axis A1, for example by means of an electric motor (not shown).

Each cleaning station 14 comprises a frame 22 that is attached to the top transverse face 24 of the platform 20.

According to the embodiment shown, the machine 10 comprises a fixed beam 26 that extends transversely above the platform 20 and that supports a distributor 28 of gas, typically of compressed air, connected to the source 16.

The distributor 28 comprises a central tubular shaft 30 that is attached to the beam 26 and that delimits a main, axial duct 31 connected to the source 16, and a connection hub 32 that is mounted so as to rotate on the shaft 30 and that comprises radial channels 33, 35 that are capable of communicating with the main duct 31.

The hub 32 comprises, at its bottom axial end, a linking disc 34 that is attached to the frame 22 so that the hub 32 is linked in rotation with the cleaning stations 14.

The distributor 28 will be described in greater detail below.

Each cleaning station 14 is fitted with an insufflation tube 36 that extends along a substantially vertical axis A2, that is connected to the distributor 28, and that is provided, at its top axial end, with a generally cylindrical nozzle 38 designed to insufflate compressed air towards the inner walls of the receptacle 12.

According to a variant embodiment (not shown), the axis A2 could be inclined relative to the main axis A1 and/or relative to the vertical direction.

The insufflation tube 36 is sleeve-fitted into a movable connection casing 40.

The movable casing 40 is guided so as to slide vertically by two vertical uprights 42, 44 forming a portion of the frame 22.

According to the embodiment shown, the movable casing 40 is fitted with a carriage 46, such as a ball bearing carriage that slides on a vertical rail 48 supported by one of the uprights 44.

The movable casing 40 is controlled so as to slide axially by a mechanism 50 comprising a roller 52 that is supported by the casing 40 and that moves on an associated rolling track 54, or cam, during a cleaning cycle.

The rolling track 54 is attached to the base 18. It comprises a section 56 of maximum height that determines a top axial position of the casing 40, hence of the insufflation tube 36, and two ramps 58, 60 that control the ascent of the insufflation tube 36 from its bottom axial position to its top axial position, and the descent of the insufflation tube 36 from its top axial position to its bottom axial position.

The bottom position of the insufflation tube 36 may be determined by an axial abutment means (not shown).

The cleaning cycle applied by a cleaning station 14 of the machine 10, during a complete rotation of the platform 20, therefore comprises an ascending phase Pm corresponding to the ascending travel of the insufflation tube 36, from its bottom position to its top position, and a descending phase Pd corresponding to the descending travel of the insufflation tube 36, from its top position to its bottom position.

During the ascending phase Pm, the nozzle 38 enters the bottle 12.

Figure 2:
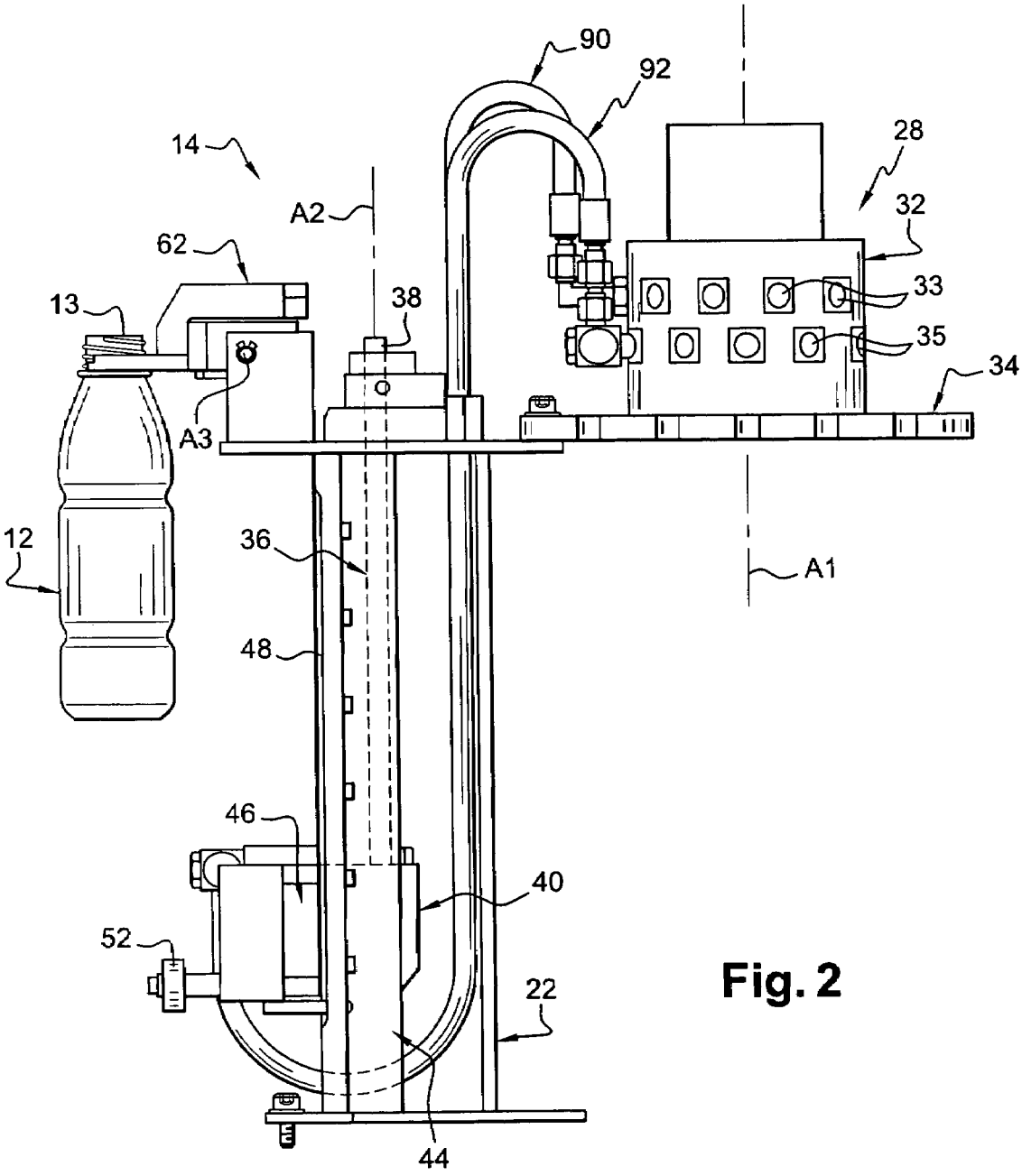
FIG. 2 is a side view that represents schematically the cleaning station of FIG. 1 fitted with an insufflation tube in the bottom position.
Figure 3:
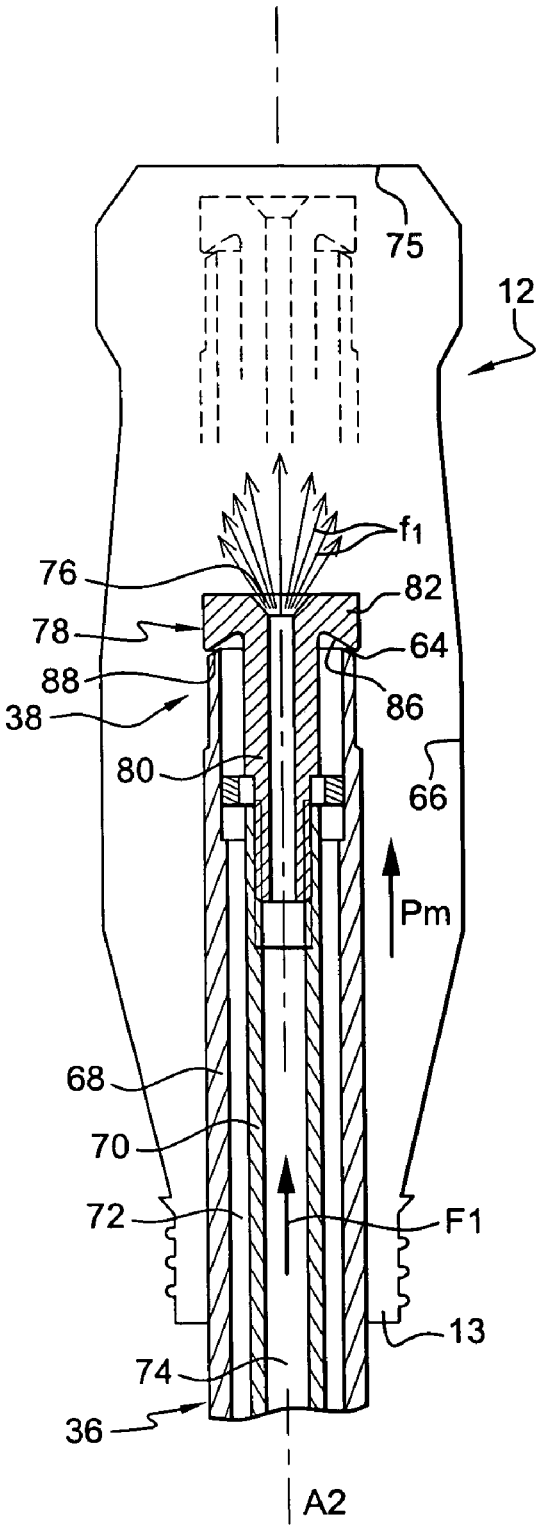
FIG. 3 is a view in axial section that represents the top end section of the insufflation tube during an ascending phase of the cleaning cycle.

The top position of the insufflation tube 36 is shown in dashed lines in FIGS. 1 and 3, and the bottom position of the insufflation tube 36 is shown in FIG. 2.

The frame 22 is fitted with support means 62 that hold the bottle 12 generally vertically so that its opening 13 is arranged downwards on the axis A2 of the insufflation tube 36 in a position called the cleaning position.

Figure 4:
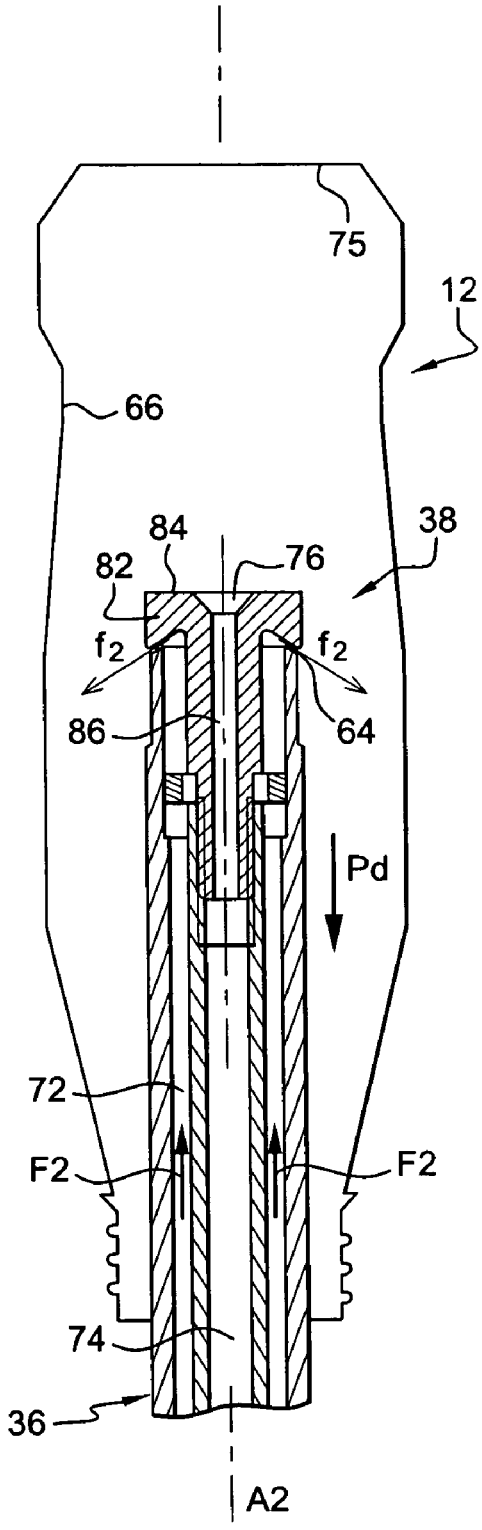
FIG. 4 is a view similar to that of FIG. 3 that represents the top end section of the insufflation tube during a descending phase of the cleaning cycle.
Figure 5:
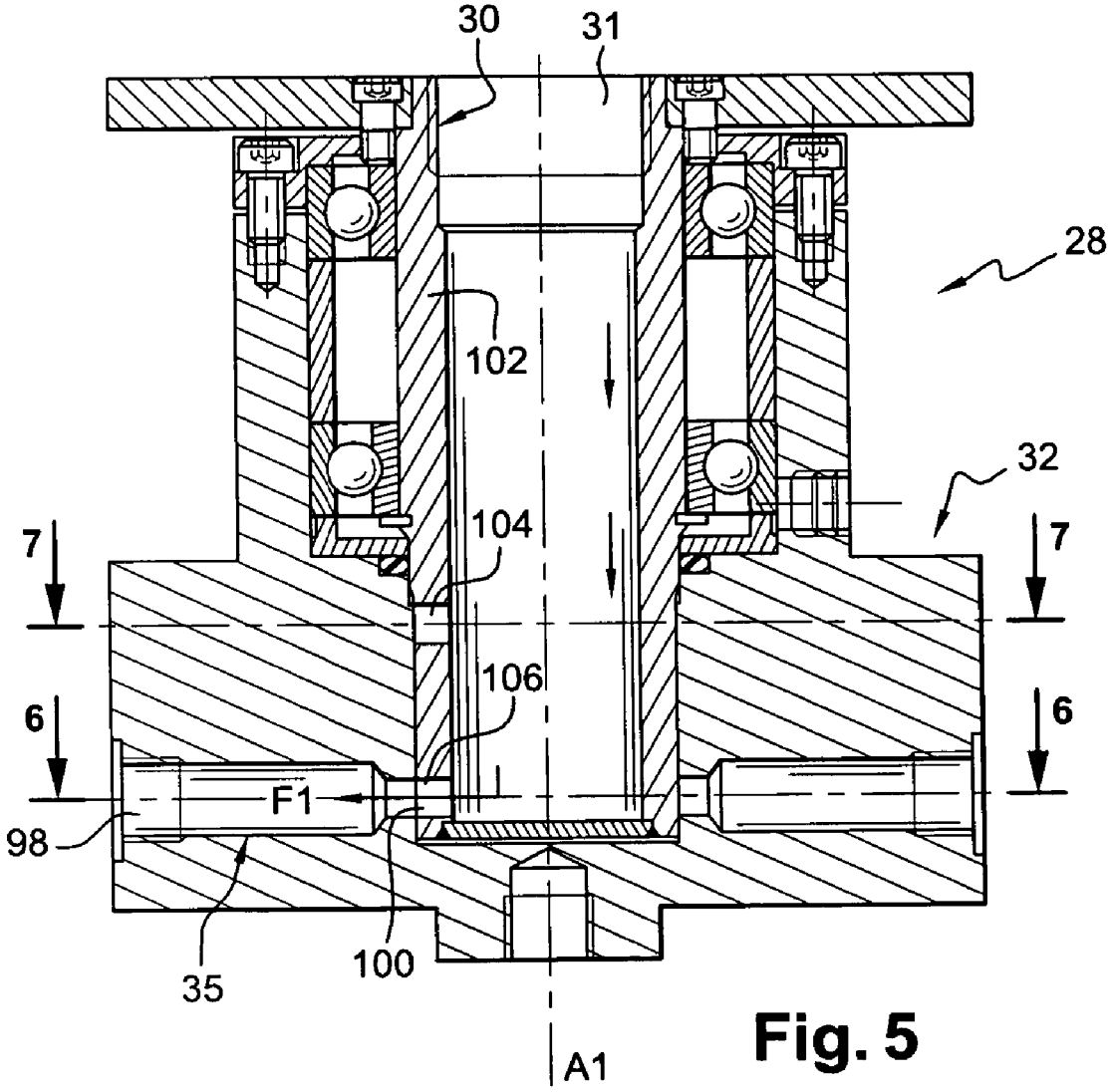
FIG. 5 is a view along the axial sectional plane 5-5 that represents schematically the compressed air distributor fitted to the machine of FIG. 1.

As illustrated, the support means 62 may comprise a pivoting pincer that is designed to grip the bottle 12 by its neck, the bottle 12 being positioned with its opening 13 upwards, as shown in FIG. 2, then to tilt the bottle about a transverse axis A3 so that it comes to occupy its cleaning position, as shown in FIGS. 1, 3, and 4.

The structure of the nozzle 38 is shown in detail in FIGS. 3 and 4, in which the insufflation tube 36 is shown, in a solid line, in an intermediate axial position between its top position and its bottom position.

The nozzle 38 comprises an annular peripheral slot 64 that is capable of forming a peripheral jet f2 of compressed air of generally frustoconical shape directed towards the inner side walls 66 of the bottle 12 and downwards.

The peripheral jet f2 is shown in FIG. 4 by arrows.

Advantageously, the insufflation tube 36 comprises an outer tube 68 and an inner tube 70 that are coaxial and that delimit between them a peripheral duct 72.

The peripheral duct 72 opens to the outside through the annular slot 64 of the nozzle 38.

The inner tube 70 delimits a central duct 74 that opens to the outside through a central orifice 76 situated at the top axial end of the nozzle 38.

The central orifice 76, that has a frustoconical profile in axial section, is designed to produce a central jet f1 of compressed air directed towards the bottom inner facing wall 75 of the bottle 12.

The central jet f1 is shown in FIG. 3 by arrows.

According to the embodiment shown, the nozzle 38 comprises a stopper 78 that partially blocks off the top axial end of the insufflation tube 36.

The stopper 78 has a shape of revolution about the axis A2 and a generally T-shaped profile in axial section.

The stopper 78 comprises a bottom tubular section 80 that is provided, at its top axial end, with a head 82 of an external diameter greater than the external diameter of the tubular section 80 and substantially equal to the external diameter of the top end of the outer tube 68.

The tubular section 80 is screwed into the top end section of the inner tube 70.

The central orifice 76 is arranged in the top transverse face 84 of the head 82.

The tubular section 80 delimits an end duct 85 which connects the central duct 74 to the central orifice 76.

The bottom annular surface 86 of the head 82 has a frustoconical shape flaring downwards.

The rim 88 of the top end of the outer tube 68 has a frustoconical shape matching the annular bottom surface 86 of the head 82, so that the axial space between the rim 88 and the bottom annular surface 86 delimits an annular slot 64 on the walls inclined relative to the axis A2 of the insufflation tube 36.

The rim 88 and the bottom annular surface 86 of the head 82 thus make it possible to guide the flow of compressed air to form a peripheral jet f2 of generally frustoconical shape.

Advantageously, the peripheral duct 72 and the central duct 74 are connected independently to the distributor 28 by means of two corresponding flexible ducts 90, 92.

Each flexible duct 90, 92 is connected, in the direction of the flow of compressed air, upstream to the connection hub 32 and downstream to the movable casing 40.

According to an advantageous feature of the machine, the distributor 28 is designed to supply compressed air only to the central duct 74, for at least a part of the ascending phase Pm, and only the peripheral duct 72, during at least a part of the descending phase Pd.

For this purpose, the connection hub 32 comprises a top connection track 94 consisting of a first series of radial channels 33 that are arranged in one and the same transverse plane and that are each connected to the peripheral duct 72 of a determined cleaning station 14, and a bottom connection track 96 consisting of a second series of radial channels 35 that are arranged generally in one and the same transverse plane and that are each connected to the central duct 74 of a determined cleaning station 14.

Figure 6:
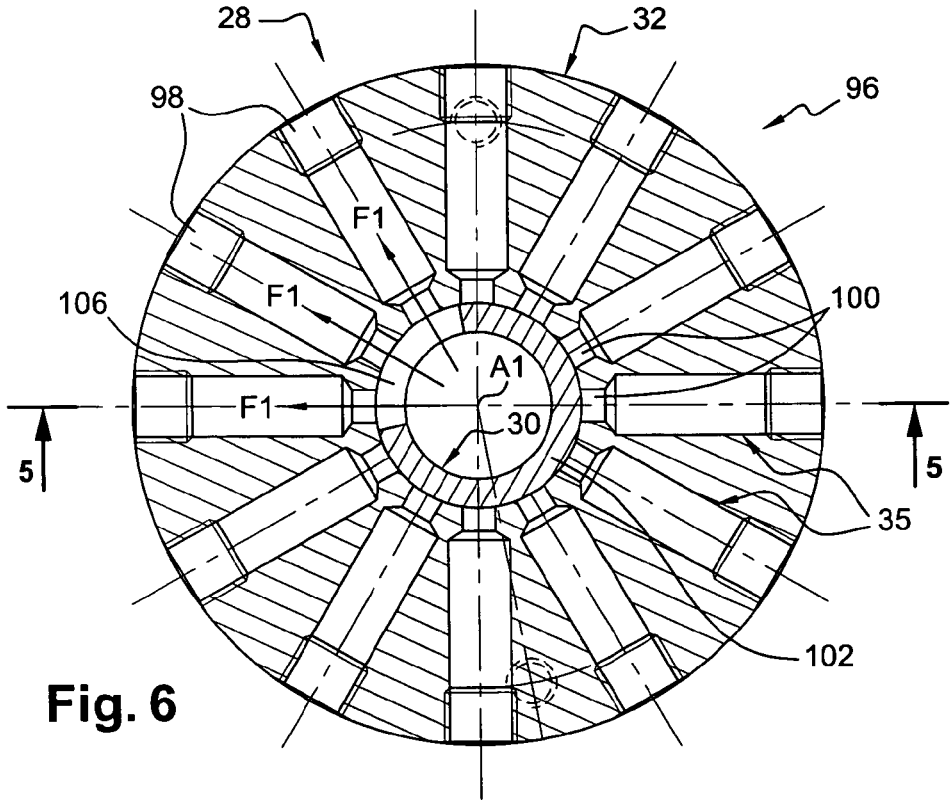
FIG. 6 is a view along the transverse sectional plane 6-6 that represents the bottom air distribution track of the distributor of FIG. 5.
Figure 7:
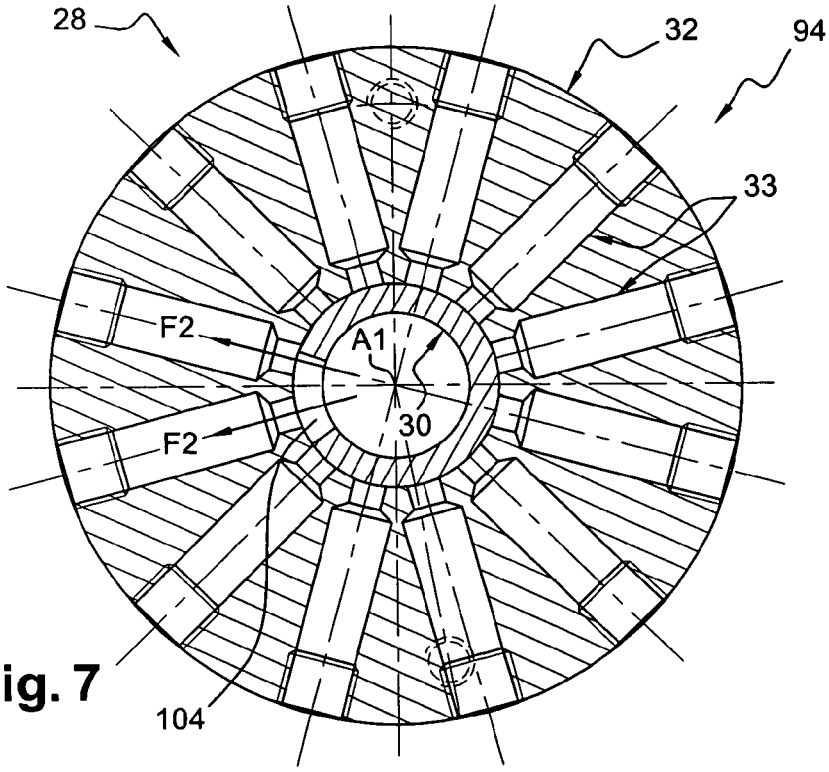
FIG. 7 is a view similar to that of FIG. 6 along the transverse sectional plane 7-7 that represents the top air distribution track of the distributor of FIG. 5.

The top connection track 94 is shown in cross section in FIG. 7 and the bottom connection track 96 is shown in cross section in FIG. 6.

Each radial channel 33, 35 comprises, at its outer end, an outer orifice 98 that is connected to an associated flexible duct 90, 92 and, at its inner end, an inner orifice 100 that opens in line with the axial wall of the main duct 31 made in the shaft 30.

The axial wall 102 of the main duct 31 comprises, at the axial height of the top track 94, a top distribution window 104 that is designed to cause several radial channels 33 of the top track 94 to communicate with the main duct 31, during an angular sector of the rotation cycle of the hub 32.

Similarly, the axial wall 102 of the main duct 31 comprises, at the axial height of the bottom track 96, a bottom distribution window 106 that is designed to cause several radial channels 35 of the bottom track 96 to communicate with the main duct 31 during an angular sector of the rotation cycle of the hub 32.

Advantageously, each distribution window 104, 106 extends over an angular sector of a value greater than the angular gap between two consecutive outer orifices 98 so as to supply simultaneously at least two radial channels 33, 35 belonging to the same track 94, 96 which makes it possible to carry out the cleaning simultaneously in at least two cleaning stations 14.

Preferably, the radial channels 33, 35 are distributed circumferentially in an even manner.

The operation of the machine 10 is now described with respect to the cleaning cycle applied by a cleaning station 14.

During the operation of the machine 10, the source 16 sends compressed air into the distributor 28 and the platform 20 is rotated about its axis A1, in the clockwise direction R considering FIG. 1.

The insufflation tube 36 and the movable casing 40 occupying their bottom position, the bottle 12 is gripped by the pincer associated with the support means 62, as shown in FIG. 2.

The pincer belonging to the support means 62 is then pivoted about its axis A3 until it comes to occupy the cleaning position.

During the pivoting of the pincer associated with the support means 62, or at the end of this pivoting, the roller 52 of the cleaning station 14, which rotates about the main axis A1, comes into contact with the ascending ramp 60 of the rolling track 54 and interacts with this ramp 60 which causes the insufflation tube 36 to slide from its bottom position to its top position.

During the majority of the ascending phase Pm, that is illustrated in FIG. 3, the inner orifice 100 of the radial channel 35 associated with the central duct 74 of the insufflation tube 36 is in line with the bottom distribution window 106, while the inner orifice 100 of the radial channel 33 associated with the peripheral duct 72 is in line with the axial wall 102 of the shaft 30. Consequently, only the central orifice 76 is supplied with compressed air that travels in the direction of the arrow F1.

The central orifice 76 of the nozzle 38 therefore produces a central jet f1 towards the inner bottom wall 75 which tends to detach the residues present in the bottle 12, in particular on the inner bottom wall 75.

In a conventional manner, the cleaning station 14 may comprise suction means (not shown) connected to the opening 13 of the bottle 12 to suck out the residues detached by the jet of compressed air.

Towards the end of the ascending phase Pm, the inner orifice 100 of the radial channel 33 associated with the peripheral duct 72 of the insufflation tube 36 comes into line with the top distribution window 104, so that the peripheral duct 72 is supplied with compressed air.

The annular slot 64 then produces the peripheral jet f2 that tends to detach the residues present on the inner walls of the bottle 12, in particular on the inner side walls 66.

The insufflation tube 36 reaches its top position, determined by the arrival of the roller 52 on the section 56 of maximum height of the rolling track 54, as shown in FIG. 1.

The roller 52 then travels along the descending ramp 58 which causes the insufflation tube 36 to slide downwards, that is to say the descending phase Pd.

At the beginning of the descending phase Pd, the inner orifice 100 of the radial channel 35 associated with the central duct 74 angularly moves beyond the bottom distribution window 106, so that the central duct 74 is no longer supplied with compressed air.

During the rest of the descending phase Pd, only the peripheral duct 72 is supplied with compressed air which travels in the direction of the arrow F2.

It is noted that the particular shape of the peripheral jet f2 of compressed air produced by the annular slot 64, namely its generally frustoconical shape, creates a major pressure drop in the top part of the bottle 12, that is to say above the peripheral jet f2.

This pressure drop, associated with the opening of the bottle being positioned downwards, makes it possible to efficiently eliminate the last residues present in the bottle 12.

At the end of the descending phase Pd, the inner orifice 100 of the radial channel 35 associated with the peripheral duct 72 moves angularly beyond the top distribution window 104, so that the peripheral duct 72 is no longer supplied with compressed air.

The bottle 12, rid of its residues, may then be removed from the cleaning station 14.

According to the embodiment described above, the central duct 74 and the peripheral duct 72 are supplied simultaneously with compressed air in the vicinity of the top position of the insufflation tube 36.

According to a variant embodiment (not shown), the distribution windows 104, 106, or the inner orifices 100, may be arranged so that the supply of the peripheral duct 72 begins after the end of the supply of the central duct 74.

The invention claimed is:

1. Machine (10) for cleaning the inner walls (66, 75) of a receptacle comprising several cleaning stations (14) that are mounted so as to rotate about a main axis (A1) and that are distributed circumferentially about the main axis (A1), characterized in that each cleaning station (14) is fitted with an insufflation tube (36) that extends along a substantially vertical axis (A2), that is connected to a source (16) of pressurized gas, and that is provided, at its top axial end, with a generally cylindrical nozzle (38) designed to insufflate the gas towards the inner walls (66, 75) of the receptacle (12), and each station comprising support means (62) that hold the receptacle (12) generally vertically so that the opening of the receptacle (12) is arranged downwards on the axis (A2) of the insufflation tube (36), a programmed controller in which the insufflation tube (36) is controlled so as to slide along its axis (A2), during a cleaning cycle, between a first top axial position, in which the nozzle (38) extends inside the receptacle (12), and a second bottom axial position, the cleaning cycle comprising an ascending phase (Pm) corresponding to the ascending travel of the insufflation tube (36), from its bottom position to its top position, and a descending phase (Pd) corresponding to the descending travel of the insufflation tube (36), from its top position to its bottom position, in that the nozzle (38) comprises an annular peripheral slot (64) that is capable of forming a peripheral jet (f2) of pressurized gas of generally frustoconical shape directed towards the inner side walls (66) of the receptacle (12) and downwards, when the nozzle (38) extends inside the receptacle (12), and in that the peripheral jet (f2) is triggered for at least a part of the descending phase (Pd) inside the receptacle (12), in that the source (16) of pressurized gas is common to several cleaning stations (14), in that the machine is fitted with a gas distributor (28) comprising

- a main fixed duct (31) that is coaxial with the main axis (A1), that is connected to the source (16) of pressurized gas and that comprises, in its axial wall (102), at least one distribution window (104, 106),
- a connection hub (32) that is mounted so as to rotate about the main duct (31), that is connected rotatably to the cleaning stations (14) and that comprises a series of radial channels (33, 35), and in that each radial channel (33, 35) comprises, at its outer end, an outer orifice (98) that is connected to the insufflation tube (36) of an associated cleaning station (14) and, at its inner end, an inner orifice (100) that opens in line with the distribution window (104, 106) during an angular sector of the rotation cycle of the hub (32) so as to cause the supply of the associated insufflation tube (36) during an adequate period of the cleaning cycle.

2. Machine (10) according to the claim 1, characterized in that the insufflation tube (36) comprises a peripheral duct (72) that opens on the outside of the annular slot (64) and a central duct (74) that opens on the outside of a central orifice (76) situated at the free axial end of the nozzle (38), and in that the central orifice (76) is capable of producing a central jet (f1) of pressurized gas directed towards the bottom inner facing wall (75) of the receptacle (12), when the nozzle (38) extends inside the receptacle (12).

3. Machine (10) according to claim 2, characterized in that the cleaning cycle comprises a phase (Pm), called the ascending phase, corresponding to the travel of the insufflation tube (36), from its first position to its second position, and a phase (Pd), called the descending phase, corresponding to the travel of the insufflation tube (36) from its second position to its first position and in that the machine comprises a gas distributor (28) that supplies only the central duct (74) during at least a part of the ascending phase (Pm) and that supplies only the peripheral duct (72) during at least a part of the descending phase (Pd).

4. Machine (10) according to claim 3, characterized in that the connection hub (32) comprises a first top track (94) of radial channels (33, 35) that are connected to the respective central ducts (74) of the associated insufflation tubes (36) and a second bottom track (96) of radial channels (33, 35) that are connected to the respective peripheral ducts (72) of the associated insufflation tubes (36), and in that the main duct (31) comprises a first top distribution window (104) that is associated with the first top track (94) and a second bottom distribution window (106) that is associated with the bottom track (96).

5. Machine (10) according to claim 4, characterized in that, considering a determined insufflation tube (36), during the ascending phase (Pm), the inner orifice (100) of the radial channel (35) associated with the central duct (74) comes into line with the said second bottom distribution window (106), the inner orifice (100) of the radial channel (33) associated with the peripheral duct (72) being in line with the axial wall (102) of the main duct (31), and, during the descending phase (Pd), the inner orifice (100) of the radial channel (35) associated with the peripheral duct (72) comes into line with the said first top distribution window (104), the inner orifice (100) of the radial channel (35) associated with the central duct (74) being in line with the axial wall (102) of the main duct (31), so that only the central duct (74) is supplied with gas during the majority of the ascending phase (Pm), and so that only the peripheral duct (72) is supplied with gas during the majority of the descending phase (Pd).

6. Machine (10) according to claim 5, characterized in that, considering a determined insufflation tube (36), in the vicinity of the said first top position of the insufflation tube (36), the inner orifices (100) of the two associated radial channels (33, 35) come into line with the corresponding distribution windows (104, 106) so that the central duct (74) and the peripheral duct (72) are supplied with gas simultaneously for a determined lapse of time.

7. Machine (10) according to claim 4 characterized in that each distribution window (104, 106) extends over an angular sector of a value greater than the angular gap between the two consecutive inner orifices (100) of the same series of radial channels (33, 35) so as to supply simultaneously at least two radial channels (33, 35) of the same series.

8. Machine (10) according to claim 1, characterized in that the gas consists of compressed air.

9. Machine (10) according to claim 5 characterized in that each distribution window (104, 106) extends over an angular sector of a value greater than the angular gap between the two consecutive inner orifices (100) of the same series of radial channels (33, 35) so as to supply simultaneously at least two radial channels (33, 35) of the same series.

10. Machine (10) according to claim 6 characterized in that each distribution window (104, 106) extends over an angular sector of a value greater than the angular gap between the two consecutive inner orifices (100) of the same series of radial channels (33, 35) so as to supply simultaneously at least two radial channels (33, 35) of the same series.

* * * * *